US008678983B1

(12) United States Patent
Brown

(10) Patent No.: US 8,678,983 B1
(45) Date of Patent: Mar. 25, 2014

(54) STRAP BASED RESISTANCE EXERCISE DEVICE

(76) Inventor: Chad Brown, El Segundo, CA (US)

( * ) Notice: Subject to any disclaimer, the term of this patent is extended or adjusted under 35 U.S.C. 154(b) by 489 days.

(21) Appl. No.: 12/949,258

(22) Filed: Nov. 18, 2010

(51) Int. Cl.
*A63B 21/002* (2006.01)
*A63B 21/00* (2006.01)

(52) U.S. Cl.
USPC ..... 482/91; 482/95; 482/131

(58) Field of Classification Search
USPC ..... 482/1–148
See application file for complete search history.

(56) References Cited

U.S. PATENT DOCUMENTS

| | | | | |
|---|---|---|---|---|
| 5,571,064 | A * | 11/1996 | Holm | 482/129 |
| 5,941,802 | A * | 8/1999 | Kiser | 482/92 |
| 6,941,620 | B1 * | 9/2005 | Hinds | 24/134 R |
| 7,044,896 | B2 | 5/2006 | Hetrick | |
| 7,090,622 | B2 | 8/2006 | Hetrick | |
| 7,137,935 | B2 * | 11/2006 | Clarke et al. | 482/123 |
| 7,326,157 | B2 * | 2/2008 | Wu | 482/126 |
| 7,438,674 | B2 * | 10/2008 | Sjodin | 482/91 |
| 7,481,747 | B2 * | 1/2009 | Lechleiter | 482/57 |
| 7,628,742 | B2 * | 12/2009 | Weaver | 482/125 |
| 7,662,073 | B1 * | 2/2010 | Baldwin | 482/92 |
| 7,744,512 | B2 * | 6/2010 | Clarke | 482/124 |
| 7,762,932 | B2 * | 7/2010 | Hetrick | 482/91 |
| 7,785,244 | B2 * | 8/2010 | Hetrick | 482/139 |
| 7,803,092 | B2 * | 9/2010 | Gilliam | 482/92 |
| 7,806,808 | B2 * | 10/2010 | Kuo | 482/52 |
| 7,811,202 | B2 * | 10/2010 | Planke | 482/7 |
| 7,837,604 | B1 * | 11/2010 | Hsu | 482/137 |
| D636,036 | S * | 4/2011 | Rios | D21/662 |
| 8,007,413 | B1 * | 8/2011 | Wu | 482/91 |
| 2002/0022555 | A1 * | 2/2002 | Nesci | 482/91 |

* cited by examiner

*Primary Examiner* — Stephen Crow
(74) *Attorney, Agent, or Firm* — Knobbe Martens Olson & Bear LLP

(57) ABSTRACT

An exercise device comprises a connector, a strap, and a T-bar. The connector is configured to be attached to a substantially stationary object. The strap is configured to extend longitudinally from the connector, and is adjustable in length. The T-bar has two grips positioned at the two ends of the T-bar. The T-bar is attachable to the end of the strap opposite the connector at substantially the center of the T-bar, such that the two grips of the T-bar are substantially equidistant from the location on the T-bar at which the strap is attached to the T-bar.

5 Claims, 1 Drawing Sheet

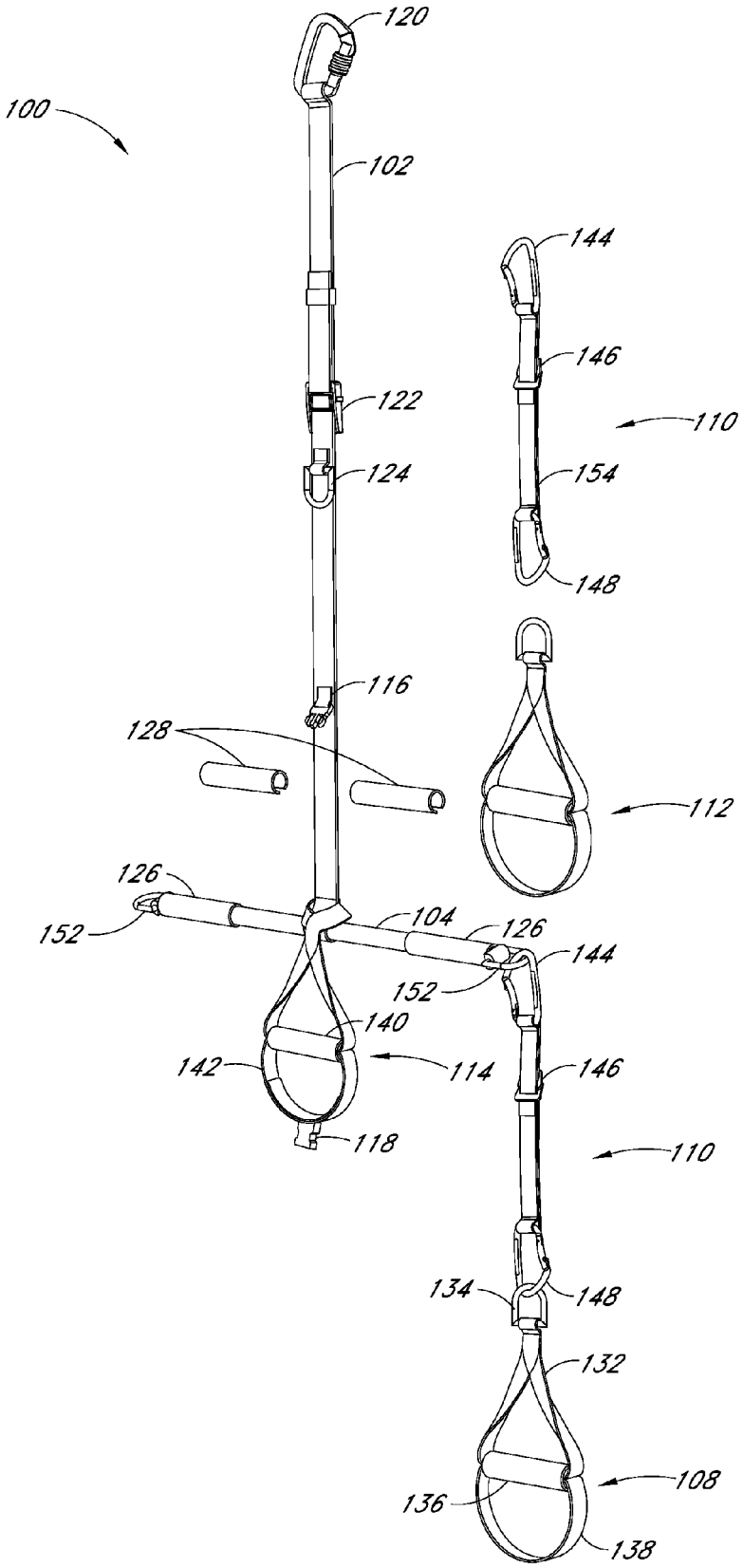
120
100
102
144
146
122
110
124
154
148
116
128
112
126
152
104
126
144
152
140
142
114
146
118
110
134
148
132
108
136
138

STRAP BASED RESISTANCE EXERCISE DEVICE

BACKGROUND OF THE INVENTION

1. Field of the Invention

Embodiments of the systems and methods described herein relate to a strap based resistance exercise device.

2. Description of the Related Art

A variety of exercise devices exist that assist a user in performing various exercises. One type of exercise device is a strap based exercise device that includes one or more straps configured to support the weight of a user's body and/or to provide resistance as the user performs various movements.

SUMMARY

Herein we describe embodiments of a strap based resistance exercise device. In one embodiment, the device includes a connector, a main strap, and a T-bar with a rubber hand grip on each end. Preferably, the main strap is adjustable to suit the height of the user and the type of exercise that the user desires to perform. Preferably, the main strap is attached to the center of the T-bar, such that the rubber hand grips are equidistant from the main strap. Advantageously, because this embodiment includes a single main strap and the rubber hand grips are equidistant from the point of attachment of the main strap to the T-bar, a user can perform a two arm movement exercise without making independent adjustments of the device for each arm. Instead, the user only needs to adjust the single main strap.

Optionally, the device also includes a single arm grip and a single foot sling attached at the junction of the main strap and the T-bar. Preferably, the single arm grip and single foot sling can be clipped to the main strap when it is not in use, in order to prevent the single arm grip and single foot grip from getting in the way of the user during two arm movement or two foot movement exercises. Preferably, when the single arm grip and single foot sling are in an unclipped position, they extend beyond the T-bar, such that a user can grasp the single arm grip with one hand, or insert his or her foot into the single foot sling during a single foot movement or single arm movement exercise. This is advantageous in comparison to a strap based exercise device having separate straps for each arm or leg, because the single arm grip and single foot sling located near the center of the T-bar eliminates the need to intertwine two straps for use during single foot movement or single arm movement exercises.

Optionally, the device also includes two stability straps that can be attached to each end of the T-bar and to the main strap at a location above the T-bar. The stability straps can be adjusted to provide more or less stability, or can be removed entirely, depending upon the experience and skill level of the user. Optionally, the device also includes accessory hand grips and foot slings that can be attached to the end of the stability straps, which, in turn, are attached to the ends of the T-bar. In such a configuration, the accessory hand grips and foot slings hang below the T-bar and allow the user to perform additional exercises.

The foregoing Summary section concisely describes only certain aspects of certain embodiments. It is not meant to describe every embodiment of the invention. The invention is not limited to the embodiments described herein or to the embodiments described in the Detailed Description. Rather, only the claims define the invention.

BRIEF DESCRIPTION OF THE DRAWINGS

FIG. 1 illustrates an embodiment of a strap based resistance exercise device.

DETAILED DESCRIPTION OF PREFERRED EMBODIMENTS

FIG. 1 illustrates one embodiment of a strap based resistance exercise device. An exercise device 100 generally comprises a main strap 102, a T-bar 104, and a connector 120. As illustrated, in one embodiment, the connector 120 is a carabiner, but a person of ordinary skill in the art will understand that any known type of connector can be used that is capable of securely attaching the exercise device 100 to a substantially stationary object. The connector 120 is preferably configured to securely attach the exercise device 100 to a wall, door frame, ceiling, post, pole, tree, or other substantially stationary object. One or more mounts, brackets, or other attachment mechanisms that are configured to be installed upon one or more substantially stationary objects and to which the connector 120 is configured to be attached in order to secure the exercise device 100 may also be provided. A person of ordinary skill in the art will understand, in light of this disclosure, that any known structure and type of mounts, connectors, or attachment mechanisms may be used.

Preferably, the main strap 102 is made of a nylon and polyester blend and is sufficiently strong to withstand breakage or deformation under the weight and/or other force applied by a person upon the main strap 102 while the person is exercising using the exercise device 102. In one embodiment, the main strap 102 is one and a half inches wide. However, the main strap 102 may be made of any material, and may be of any width, that provides sufficient strength. Preferably, the main strap 102 is substantially inelastic, or minimally elastic, during use of the exercise device 100. However, in some embodiments, the main strap 102 may be elastic, and such elasticity may contribute to the resistance provided by the exercise device 100.

In one advantageous embodiment, the strap 102 is adjustable and includes a cam buckle 122 configured to allow adjustment of the length of the strap 102. Preferably the length of the strap 102 can be adjusted from 30 inches to 37.75 inches. Alternatively, the length of the strap 102 may be shorter than 30 inches or longer than 37.75 inches. For example, the minimal length of the strap may be about 6 inches, 12 inches, 18 inches, 24 inches, 30 inches, or 36 inches, while the maximal length of the strap may be about 30 inches, 36 inches, 42 inches, 48 inches, 54 inches, of 60 inches. A skilled artisan will appreciate, in light of this disclosure, that the strap may be adjustable by length within a range that includes any one of the minimal lengths and any one of the maximal lengths that is larger than the minimal length. Moreover, a skilled artisan will appreciate, in light of this disclosure, that any other length may be used. Advantageously, allowing the length of the strap 102 to be adjusted allows the exercise device 100 to be used effectively by users of different height and for different types of exercises. For some exercises, the length of the strap 102 may be adjusted in order to change the amount of resistance that the user of the device 100 experiences during an exercise. The adjustability of the strap 102 is an optional feature, and it is not required that all embodiments include an adjustable strap.

Preferably, the T-bar 104 comprises a metal, plastic, or composite bar with rubber grips 126 on each end that function as handles. In one embodiment, the T-bar 104 is made of aluminum. In one embodiment, the T-bar 104 is essentially in the form of a straight bicycle handlebar, such as is generally used for mountain bikes. Any known metal, plastic, or composite that is sufficiently strong to withstand breakage or deformation during exercise may be used. Preferably, the grips 126 are lock on grips that can be exchanged without replacing the entire T-bar 104.

Preferably, the T-bar 104 has a length that is related to the width of a user's shoulders such that the exercise device 104 is both comfortable and effective for the user. Preferably, at least three sizes of T-bars are available, including, without limitation, a 22.75 inch "large" T-bar, a 22 inch "medium" T-bar, and a 21.75 inch "small" T-bar. In one embodiment, one fixed length T-bar 104, the particular length of which may be chosen by the consumer, is provided with the exercise device 100. Alternatively, multiple T-bars of different sizes may be provided, and the T-bars may be switched by the user. Alternatively, a single T-bar of adjustable length may be provided.

In one embodiment, in addition to the rubber grips 126, extra padding 128 is provided that can be attached to or removed from the T-bar 104 according to the comfort of the user. In one embodiment, the extra padding 128 comprises rubber circular sleeves that each have a slit along the entire length of the sleeve that is configured to receive the T-bar 104 such that the sleeves wrap around the T-bar 104.

Advantageously, an embodiment that includes a connector 120, strap 102, and T-bar 104 is a fully functional, simple, and easily transportable exercise device that can be used for a variety of exercises. Embodiments of the exercise device 102 disclosed herein are particularly advantageous for use in exercises in which it is desirable to have both of a user's hands positioned at an equal distance from the anchor point of the exercise device 102. Some strap based resistance exercise devices have had two independent straps extending from a central anchor point, with each of the straps ending in a handle for one of the user's hands. In such devices, the straps are independently adjustable, such that the length of one strap may be longer than the length of the other strap. A disadvantage of independent straps is that it can be difficult to adjust both straps such that they are the same length. Advantageously, the use of a single adjustable strap 102 ending in a T-bar 104 that provides grips for both of a user's hands eliminates the need to separately adjust the strap length for each of the user's two hands. Rather, only one strap adjustment is required, and the one strap design ensures that the user's two hands are positioned the same distance from the anchor point of the exercise device 102. Thus, for several types of exercises, in which it is desirable to have both of the user's hands at the same distance from the anchor point, embodiments of the exercise device 102 can be more easily adjusted and used than other strap based resistance exercise devices.

Other components illustrated in FIG. 1 are optional components of some embodiments of the exercise device 100. In one embodiment, an optional handle and foot sling unit 114 is attached at the junction between the strap 102 and T-bar 104. In one embodiment, the unit 114 comprises a handle 140 and a foot sling 142. Advantageously, because the handle 140 is positioned such that it is essentially an extension of the strap 102, it can be used for single arm movement exercises. Similarly, the foot sling 142 can be used for single leg movement exercises. In some other strap based resistance exercise devices, single arm or leg movement exercises require the user to intertwine the two handles of the device. The inclusion of the unit 114 at the junction between the strap 102 and T-bar 104 eliminates the need of intertwining two handles. Preferably, the foot sling 142 includes padding for comfort of the user. Preferably, one mating portion of a tex buckle 118 is attached to the foot sling 142 that can be connected to another mating portion of a tex buckle 116 attached to the strap 102, thus allowing the unit 114 to be clipped to the strap 102, and, thus, out of the way, during exercises for which neither the handle 140 nor foot sling 142 is used.

The exercise device 100 also optionally includes two stability straps 110, D-ring 124, and D-rings 152 to provide adjustable stability control. Preferably, the D-ring 124 is positioned below the cam buckle 122 on the strap 102 such that the distance between the D-ring 124 and the T-bar 104 is not affected by the length adjustment of the strap 102. Alternatively, the D-ring 124 may be attached to the strap 102 at a position above the cam buckle 122. Preferably, the stability straps 110 include a first carabiner 144, a second carabiner 148, a buckle 146 and a strap 154. Preferably, each strap 154 is made of a polyester and nylon blend, but other materials may be used, as would be appreciated by a person of ordinary skill in the art in view of this disclosure. Preferably, the straps 154 are substantially inelastic, but elastic straps may be used. Preferably, each strap 154 is adjustable in length, and the buckle 146 is used to lock the length of the strap 154 into place. Preferably, the buckle 146 is a quick-release buckle, but this is not required.

In one embodiment, the D-ring 124 is attached to the strap 102 by a fabric loop attached to the strap 102, and is movable about an axis. Further, as illustrated on FIG. 1, the D-rings 152 are moveable about an axis at the end of the T-bar 104.

In one embodiment, the stability straps 110 may optionally be attached to the exercise device 100, with one of the carabiners 144 or 148 being hooked to one of the D-rings 152 and the other of the carabiners 144 or 148 being hooked to the D-ring 124. Attaching the stability straps 110 to the exercise device 100 in this fashion provides stability to, and reduces movement of, the T-bar 104, during exercise. Advantageously, allowing the straps 154 to be adjusted allows a user to adjust the desired degree of stability of the T-bar 104. Generally, tightening the straps 154 (i.e. making them shorter) increases tension in the straps 154 and causes the T-bar 104 to be more stable and to move around less, while loosening the straps 154 (i.e. making them longer) decreases tension in the straps 154 and causes the T-bar 104 to be less stable and to move around more. As will be appreciated by a skilled artisan, in light of this disclosure, increased stability generally increases the ease of an exercise while decreased stability generally increases the difficulty of an exercise. Accordingly, beginners may want to shorten the stability straps 110 for increased stability, while more experienced users may want to lengthen the stability straps 110 for decreased stability or to not even attach the stability straps 110 to the exercise device 100.

The exercise device 100 also optionally includes two accessory handle units 108 that are configured to be attached, via the stability straps 110, to the D-rings 152 of the T-bar 104. As illustrated in FIG. 1, one of the carabiners 144 of the stability strap 110 is connected to the D-ring 104 of the T-bar 104. The other of the carabiners 148 is connected to a D-ring 134 of the accessory handle unit 108. In one embodiment, the accessory handle unit 108 comprises a D-ring 134, a handle grip 136 that is attached to handle fabric 132, and a foot sling 138. The accessory handle units 108 advantageously provide optional components that extend the type of exercises that may be performed using the exercise device 100.

Embodiments of the exercise device 100, as disclosed herein, allow a user to perform a variety of exercises. The exercises that may be performed using the exercise device 100 include, without limitation, a hanging upper body chest press, a hanging standing chest press, a hanging back row, a hanging single arm row, a hanging single leg back lunge, a hanging single leg squat, and other exercises. A short description of these exercises follows:

A person starts a hanging upper body chest press with both hands on the floor with shoulder width space. Then, the person places both feet on top of the T-bar having his or her body in a plank position. The person then bends his or her elbows to lower the chest to the floor and then presses back up to the start position. The person should make sure to keep the head in a neutral position, butt up and abs tight, and chest over the hands.

A person starts a hanging standing chest press by unclipping the stability straps and hooks on the handles. From a standing upright position, the person places both hands on the handle with the T-bar at his or her back, with arms straight in front at chest line height There should be tension on the straps at all times. From this starting position, the person keeps his or her body aligned and steps back to a desired angle while on his or her toes. The person bends the elbows to a 90 degree angle, then pushes back to the start position. The person should keep his or her feet shoulder width apart, the elbows below the shoulders, and the abs and butt tight.

A person starts a hanging back row by grabbing the handle by an overhand grip facing the strap. The person's body should be aligned with chest out and on his or her heels. From this starting position, the person walks down to a desired angle, pulls the chest to the bar, then lowers back towards the floor. The person should keep the butt and abs tight, and should lead with the chest first and pelvis second.

A person starts a hanging single arm row by unbuckling the single arm movement handle from the strap. The person then grips the single arm movement handle with one hand. The person's feet should be shoulder width apart. Facing the anchor point, the person pulls the handle to his or her armpit while in an upright position. From this starting position, the person unbends the arm with the palm facing down towards the floor. The person keeps his or her heels down, toes up, and body aligned, and swings his or her opposite hand towards the floor. Then, the person brings his or her body and arm back to the start position. The person's feet should be facing the anchor point at all times.

A person starts a hanging single leg back lunge by unbuckling the single leg movement handle from the strap. The single leg movement handle should be knee height while hanging from the wall. The person places his or her foot in the sling. The person then hops a foot and a half from the anchor point, with his or her body facing away from the strap. From this start position, the person bends his or her front leg into a 90 degree angle, keeping pressure on the heel, while the hanging leg goes back towards the anchor line, creating a 90/90 look. Then the person returns to the start position. The person should make sure to use the foot in the front to push back up and not the leg in the sling.

A person starts a hanging single leg squat by grabbing onto the bar with an overhand grip while facing the anchor point. The person walks back away from the center point, making the bar at chest height and keeping the elbow bent. From this starting position, the person, keeping over his or her heels, lifts one leg straight out in front of his or her body. The person then lowers himself or herself down towards the floor, keeping the chest up and heel down. The person goes past a 90 degree bend then pushes back up to the start position, keeping the lifted leg up during the exercise. The person should make sure to push through the heel and keep the chest up, and should try not to use the bar to pull himself or herself up with the arms. In this exercise, the higher the bar is positioned, the easier it will be for the person to assist himself or herself with it.

A skilled artisan, including anyone with sufficient knowledge of exercising and training, will understand, in light of this disclosure, how to use the exercise device 100 for these and other exercises. Moreover, a skilled artisan will appreciate, in light of this disclosure, that the use or optional components, such as, for example, the accessory handle units 108, may enable a user to perform additional exercises, or to enhance the performance of exercises, that may not be able to be performed, or may not be able to be performed as well, without the optional components.

In general, a user does the following to use the exercise device 100 to perform an exercise: (1) the user attaches the exercise device 100 to a substantially stationary object with the connector 120, (2) the user attaches any available and desired optional components, (3) the user grips the exercise device 100 with his or her hand or hands or attaches the exercise device to his or her foot or feet, and (4) the user performs the physical actions associated with the particular exercise that the user desires to perform. Additionally, the user may, but is not required to, adjust the exercise device 100 prior to performing an exercise. For example, in embodiments that include an adjustable strap 102, the user may adjust the length of the adjustable strap 102 to suit the user's height and the type of exercise that the user desires to perform. Similarly, if the user is using the stability straps 110, the user may adjust the adjustable straps 154 as desired.

With respect to step (1) in the above paragraph, the substantially stationary object may be a wall, a door frame, a pole, a bar, a tree, or any other substantially stationary object. The step of attaching the exercise device 100 may include attaching the connector 120 to a mount that is attached to the substantially stationary object. With respect to step (2) in the above paragraph, the user may attach one or more accessory handle units 108, the user may attach one or more stability straps 110, or the user may put the unit 114 in an unclipped position such that the user can use the unit 114 for a single arm movement or single leg movement exercise.

We have described the foregoing embodiments by way of example and not limitation. A skilled artisan will appreciate, in light of this disclosure, that the invention is not limited to the disclosed embodiments, but encompasses the disclosed embodiments individually, combinations of features of the disclosed embodiments, and variations of the disclosed embodiments that are apparent to a skilled artisan in light of this disclosure. For example, a skilled artisan will appreciate that many of the features described herein can be modified or omitted from certain embodiments without departing from the invention.

I claim:

1. An exercise device comprising:

a connector configured to be attached to a substantially stationary object;

a ribbon-shaped fabric strap configured for use in an exercise in which a person's body weight provides resistance, the strap having a height, a width, a length, a cam buckle, a first end, a second end, and at least one D-ring attached to the strap at a position between the first end and the second end, the first end being attached to the connector, the width of the strap being larger than the height of the strap, the length of the strap being larger than the width of the strap, and the strap being configured to extend longitudinally from the connector and to be adjustable in length, by use of at least the cam buckle, such that the second end of the strap can be positioned at least 24 inches, and up to 48 inches, away from the connector; and a T-bar having a first end, a second end, a first grip and a first T-bar D-ring attached to the T-bar substantially at the first end of the T-bar, and a second grip and a second T-bar D-ring attached to the T-bar substantially at the second end of the T-bar, the T-bar being attachable to the second end of the strap at substantially the center of the T-bar, such that the first grip of the T-bar and the second grip of the T-bar are substantially equidistant from the location on the T-bar at which the strap is attached to the T-bar, the first T-bar D-ring and the D-ring on the strap being configured to connect to opposite ends of a first attachable stability strap and the second T-bar D-ring and the D-ring on the strap being configured to connect to opposite ends of a second attachable stability strap.

2. The device of claim 1, further comprising a handle and foot sling attached at a juncture of the second end of the strap and the T-bar, wherein the handle and foot sling can be positioned in a first position, in which the handle and foot sling hangs below the T-bar for use in a one arm movement or one leg movement exercise, or in a second position, in which the handle and foot sling are clipped to the strap at a location above the T-bar so as to be out of the way of a user during a two arm movement or two leg movement exercise.

3. The device of claim 1, further comprising one or more stability straps attachable to the strap D-ring at a location above the T-bar and to either the first T-bar D-ring at the first end of the T-bar or the second T-bar D-ring at the second end of the T-bar.

4. The device of claim 1, further comprising one or more accessory handles and foot slings attachable by a strap to the first T-bar D-ring at the first end of the T-bar or the second T-bar D-ring at the second end of the T-bar.

5. The device of claim 1, wherein the strap is substantially inelastic.

* * * * *